US008895858B2

(12) United States Patent
Heffner et al.

(10) Patent No.: US 8,895,858 B2
(45) Date of Patent: Nov. 25, 2014

(54) PROFILE FILLER TUBES IN LAN CABLES

(75) Inventors: Greg Heffner, Denver, PA (US); Joshua Keller, Mechanicsburg, PA (US); Qibo Jiang, Ephrata, PA (US); Paul Kroushl, Lancaster, PA (US); Fredric Jean, Manheim, PA (US); Kathy Perevosnik, Ephrata, PA (US)

(73) Assignee: NEXANS, Paris (FR)

( * ) Notice: Subject to any disclaimer, the term of this patent is extended or adjusted under 35 U.S.C. 154(b) by 232 days.

(21) Appl. No.: 13/539,978

(22) Filed: Jul. 2, 2012

(65) Prior Publication Data

US 2014/0000935 A1 Jan. 2, 2014

(51) Int. Cl.
*H01B 7/00* (2006.01)
*H01B 17/00* (2006.01)

(52) U.S. Cl.
USPC ..... 174/116

(58) Field of Classification Search
USPC ..... 174/116
See application file for complete search history.

(56) References Cited

U.S. PATENT DOCUMENTS

| | | | | |
|---|---|---|---|---|
| 6,365,836 | B1 | 4/2002 | Blouin et al. | |
| 7,534,964 | B2 * | 5/2009 | Clark et al. | 174/113 R |
| 7,550,674 | B2 * | 6/2009 | Jean | 174/110 R |
| 2003/0121695 | A1 | 7/2003 | Wiebelhaus et al. | |
| 2006/0169479 | A1 | 8/2006 | Dillon et al. | |
| 2010/0000753 | A1 | 1/2010 | Juengst | |
| 2011/0168426 | A1 | 7/2011 | Kim et al. | |
| 2013/0126209 | A1 * | 5/2013 | Heffner | 174/113 R |

FOREIGN PATENT DOCUMENTS

| | | |
|---|---|---|
| EP | 1548754 | 6/2005 |
| WO | 2005048274 | 5/2005 |
| WO | 2006088852 | 8/2006 |
| WO | 2010093892 | 8/2010 |

* cited by examiner

*Primary Examiner* — Timothy Thompson
*Assistant Examiner* — Charles Pizzuto
(74) *Attorney, Agent, or Firm* — Sofer & Haroun, LLP

(57) ABSTRACT

A cable is provided containing one or more polymeric elements for reduction of crosstalk. The cable includes a plurality of unshielded twisted pairs, each of which is an insulated conductor pair twisted around one another, each having a different lay length. A jacket encloses the plurality of unshielded twisted pairs, where an unshielded twisted pair, has the longest lay length among the plurality of unshielded twisted pairs is positioned within the center of the jacket such that an axis of the twisted pairs that has the longest lay length substantially coincides with the central longitudinal axis of the cable. A plurality of bumper elements are disposed within the jacket in the interstices between said plurality of unshielded twisted pairs, where the bumper elements are profiled polymer structures.

11 Claims, 17 Drawing Sheets

PROFILE FILLER TUBES IN LAN CABLES

BACKGROUND

1. Field of the Invention

The present invention relates to the field of cables. More particularly, the present invention relates to filler components used in communication cables.

2. Description of Related Art

Communication cables are broadly grouped into two arrangements, fiber optic cables and metal conductor cables, each of which has their own unique set of construction parameters that affect the quality of the communication signals carried therethrough.

Regarding metal conductor cables, one typical arrangement is the LAN (Local Area Network) cable that is usually constructed of four pairs of twisted insulated copper conductors encased within a jacket. Other larger cables may employ more pairs of conductors.

In this typical four pair LAN cable construction, in addition to protecting against external environmental interferences, in order to decrease cross talk between signals passing through one pair, and signals passing through adjacent pairs within the same LAN cable, the pairs of conductors are twisted. Moreover, as the signal interference between pairs is highest when conductors of adjacent pairs lie parallel to one another, pairs are twisted around one another at different rates (i.e. at different lay lengths) to minimize the instances of parallel conductors in adjacent pairs. Other items such as tapes, fillers, or cross fillers may be added to even further reduce the amount of cross talk between pairs within the cable.

For example, in prior art arrangements where four twisted pairs are included in one jacket it is common to use four different lay lengths, one for each of the four twisted pairs. These varied rates of twisting result in a reduced number of incidences where the wires in the pairs run parallel to one another, effecting a reduction in crosstalk. For example, in a typical four pair cable, arranged in a compact square/rectangle, there are six different crosstalk combinations that need to be addressed, as shown in prior art FIG. 1 (labeled C1-C6).

It is typically known that the shorter the lay length of a particular pair in a multi-pair cable, the more crosstalk is reduced. However, shorter lay lengths obviously use more wire per length of cable, and thus there are limitations on how short the lay length can be in any given copper wire twisted pair. Therefore, it is ideal to have the longest lay length possible that meets the desired crosstalk threshold.

One prior art manner for addressing such cross talk issues is to isolate the longest lay length pair in a four pair LAN cable, making it equidistant to the other three pairs in the same cable and as far as possible from other pairs in adjacent LAN cables. For example, as shown in U.S. Pat. No. 7,550,674, a plurality of unshielded twisted pairs are provided, each of which has a different lay length. The jacket encloses the plurality of unshielded twisted pairs, and the unshielded twisted pair that has the longest lay length among the plurality of unshielded twisted pairs positioned within the center of the jacket, substantially along the central longitudinal axis of the cable. See prior art FIG. 2.

To maintain such geometry and its advantageous electrical characteristics, bumper elements are disposed around the central pair in between the outside pairs. The bumper elements are typically polymers formed as solid, foamed or hollow structures, however, alternative materials and structures may be used. These bumpers are advantageously of a dimension substantially equal to the diameter of a twisted pair, and are used for maintaining a regular geometry along the length of cable as shown in FIG. 2.

However, the necessity of the bumpers to maintain the pair geometry in the cable necessarily leads to the drawback of using additional components in the cable, which is always a disadvantage in cable construction owing to added size, weight, cost and fuel load (fuel load affects the flame and smoke performance of cable constructions in flame tests).

Another problem with these bumpers is that their proximity to the pairs that they separate disturbs the signal's electromagnetic field and reduces the effectiveness of the transmission signal through the pair owing to the detrimental dielectric properties of the polymers from which they are constructed. Although foaming the polymers used to make these bumpers is a possible solution and in theory could yield improved electrical performance, foaming is generally a non-preferred option owing to its added processing/extrusion difficulties versus solid profile extrusion.

OBJECTS AND SUMMARY

The present arrangement overcomes certain drawbacks with the prior art by providing a low cost and effective bumper for maintaining proper spacing geometry of the twisted pairs within a communications/LAN cable without requiring the use of foamed polymers.

Such improved bumpers are profiled so as to maintain a sufficient cross sectional diameter at any point along the length of the cable, while simultaneously significantly reducing polymer consumption making use of a profiled shape. Moreover, the profiled shapes of the bumpers include significant airspace reducing the overall negative dielectric effects on the signals in the pairs adjacent the bumpers.

To this end the present arrangement is directed to a cable containing one or more polymeric elements for reduction of crosstalk. The cable includes a plurality of unshielded twisted pairs, each of which is an insulated conductor pair twisted around one another, each having a different lay length. A jacket encloses the plurality of unshielded twisted pairs, where an unshielded twisted pair, having the longest lay length among the plurality of unshielded twisted pairs is positioned within the center of the jacket such that an axis of the twisted pairs has the longest lay length substantially coincides with the central longitudinal axis of the cable.

A plurality of bumper elements are disposed within the jacket in the interstices between said plurality of unshielded twisted pairs, where the bumper elements are profiled polymer structures.

In another arrangement, a cable containing one or more polymeric elements for reduction of crosstalk is provided having a plurality of unshielded twisted pairs, each of which is an insulated conductor pair twisted around one another, the plurality of unshielded twisted pairs having different lay lengths.

A central spacing element is provided around which the unshielded twisted pairs are arranged. One or more peripheral spacing elements are arranged within the unshielded twisted pairs to maintain the spacing of the unshielded twisted pairs.

A jacket is provided enclosing the plurality of unshielded twisted pairs and central and peripheral spacing elements, where the spacing elements are profiled polymer structures.

BRIEF DESCRIPTION OF THE DRAWINGS

The present invention can be best understood through the following description and accompanying drawings, wherein.

DETAILED DESCRIPTION

Figure 3:
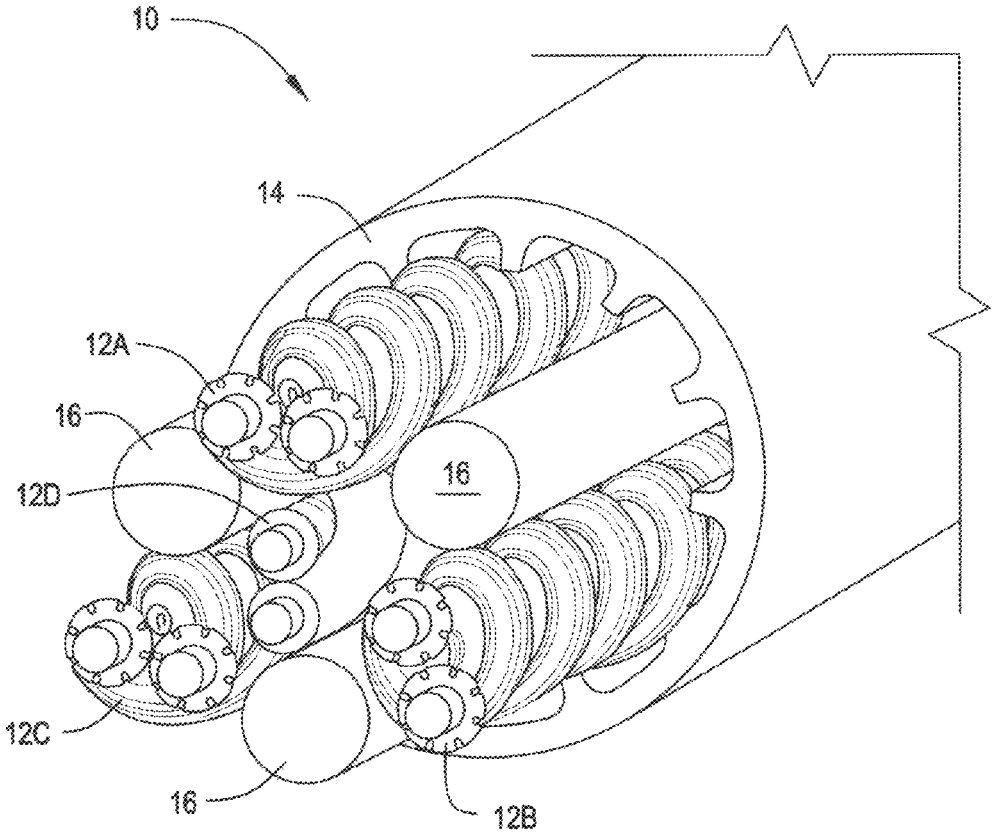
FIG. 3 (PRIOR ART)
FIG. 3 shows the basic components of the communications cable according to one embodiment using the prior art geometry/arrangement as a model.

In one embodiment of the present invention, shown using prior art FIG. 3 as an exemplary structural model, a cable 10 is provided having four twisted pairs 12*a*-12*d* of unshielded copper wire within an outer extruded jacket 14.

For the purposes of illustrating the salient features of the present invention cable 10 is shown to have four twisted pairs 12. However, the invention is not limited in this respect. The present invention may also be applied to cables having larger or smaller counts of twisted pairs 12 as desired.

Twisted pairs 12*a*-12*d* are described as copper, but any desired conductive metal may be substituted as desired. Furthermore, the copper in pairs 12 are coated with typical polymer coatings, such as PE (Polyethylene) or FEP (Fluoronated Ethylene Polymer) or other insulators based on the desired cost and fire safety standards. Jacket 14 is also an extruded polymer as well, formed from PVC (Poly Vinyl Chloride) or FRPVC (Flame Resistant PVC), or other such polymer compositions.

As with standard four pair cables each of twisted pairs 12*a*-12*d* has a different rate of rotational twisting resulting in different lay lengths. In the present illustration, twisted pair 12*a* is presumed to have the shortest lay length and pair 12*d* has the longest lay length. For example a typical cable 10 may employ lay lengths in the ranges of 0.3" to 0.55" (0.3", 0.325", 0.35" and 0.55"). Obviously, these lay lengths for pairs 12 are by way of illustration only, with the invention being equally applicable to any desired lay lengths depending on the desired crosstalk tolerance and desired mechanical (weight etc. . . . ) specifications.

As shown in FIG. 3, pairs 12*a*-12*d* are arranged in a three spoked wheel arrangement with pair 12*d*, having the longest lay length, being centrally located substantially along the center longitudinal axis of cable 10. The three pairs 12*a*-12*c* having the shorter lay lengths are disposed apart from one another, outwards towards the inside diameter of jacket 14. Ideally, pairs 12*a*-12*c* are disposed substantially 120° apart.

In one embodiment of the present invention, bumper elements 16 are disposed around central pair 12*d* and in between pairs 12*a*, 12*b* and 12*c* respectively. As described in full detail below bumper elements 16 are typically polymers formed using specialized shapes to simultaneously maintain the geometry of pairs 12*a*-12*d* while reducing the amount of polymer used and maximizing the amount of open space/air to reduce any dielectric interference in the signals in pairs 12*a*-12*d*.

A reduction of polymer content can be achieved by the introduction of contoured/shaped bumpers 16 as described in more detail below. The shapes for contoured bumpers 16 can differ, but, regardless of the shape, should retain its structural integrity against crushing, bending, puffing, and normal abuse of cable 10. In General, the polymer materials used for bumpers 16 may be selected from, but are not limited to high temperature materials such as FEP, PTFE, PFA, ETFE, etc. and low temperature materials such as PVC, FRPVC, PE, FRPE, PP, FRPP, LSZH compounds, etc. . . .

Figure 1:
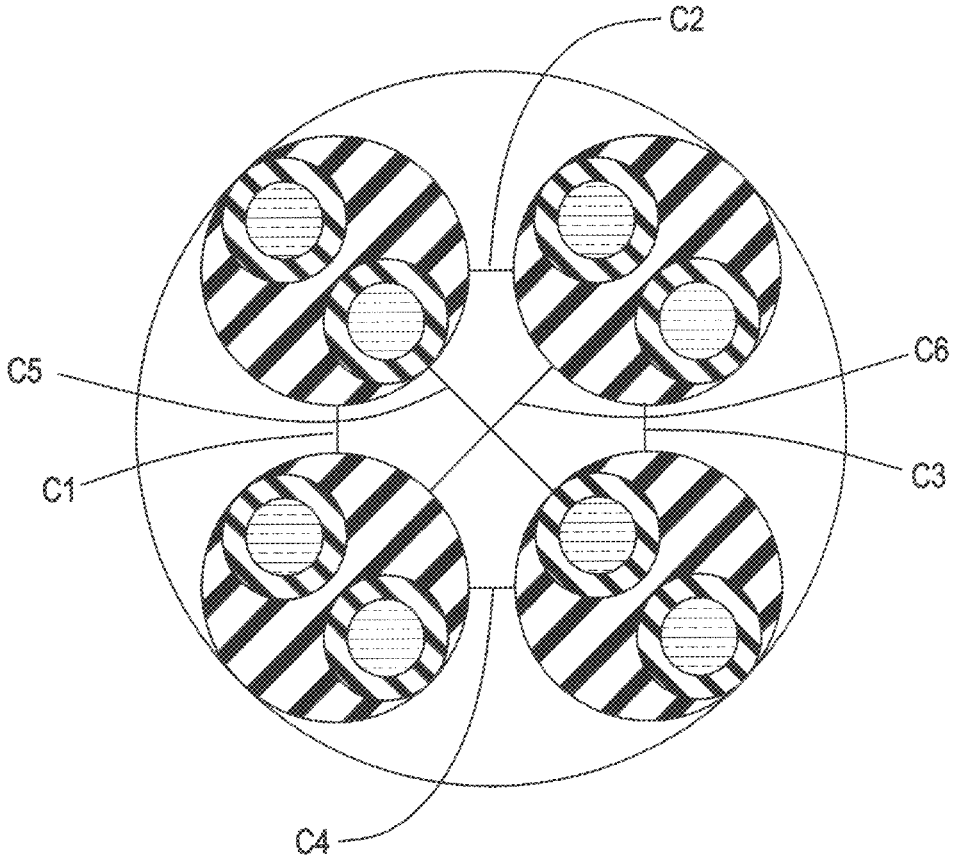
FIG. 1 (PRIOR ART)
FIGS. 1-2 show prior art LAN cable constructions.
Figure 2:
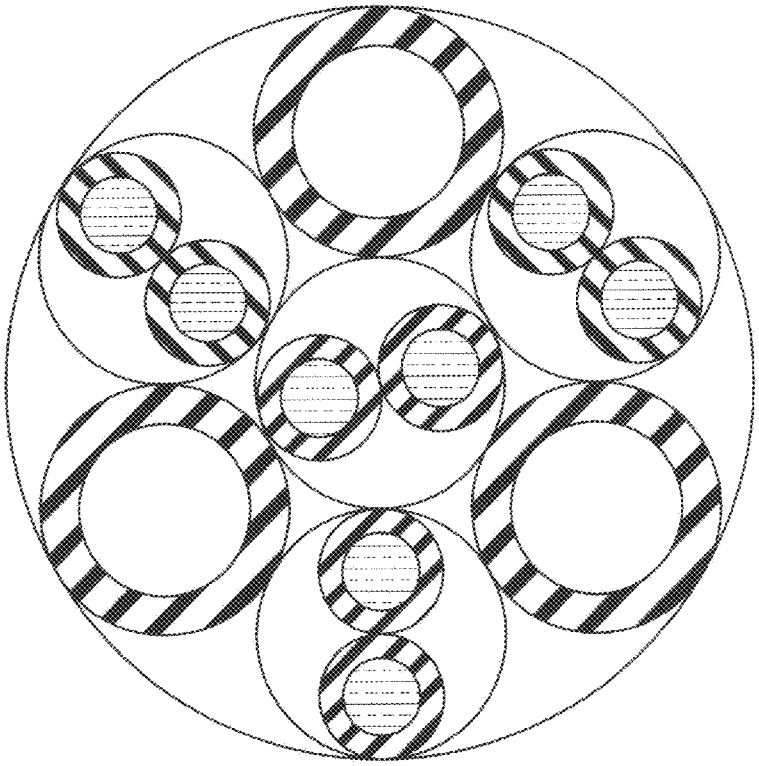
FIG. 2 (PRIOR ART)
Figure 4A:
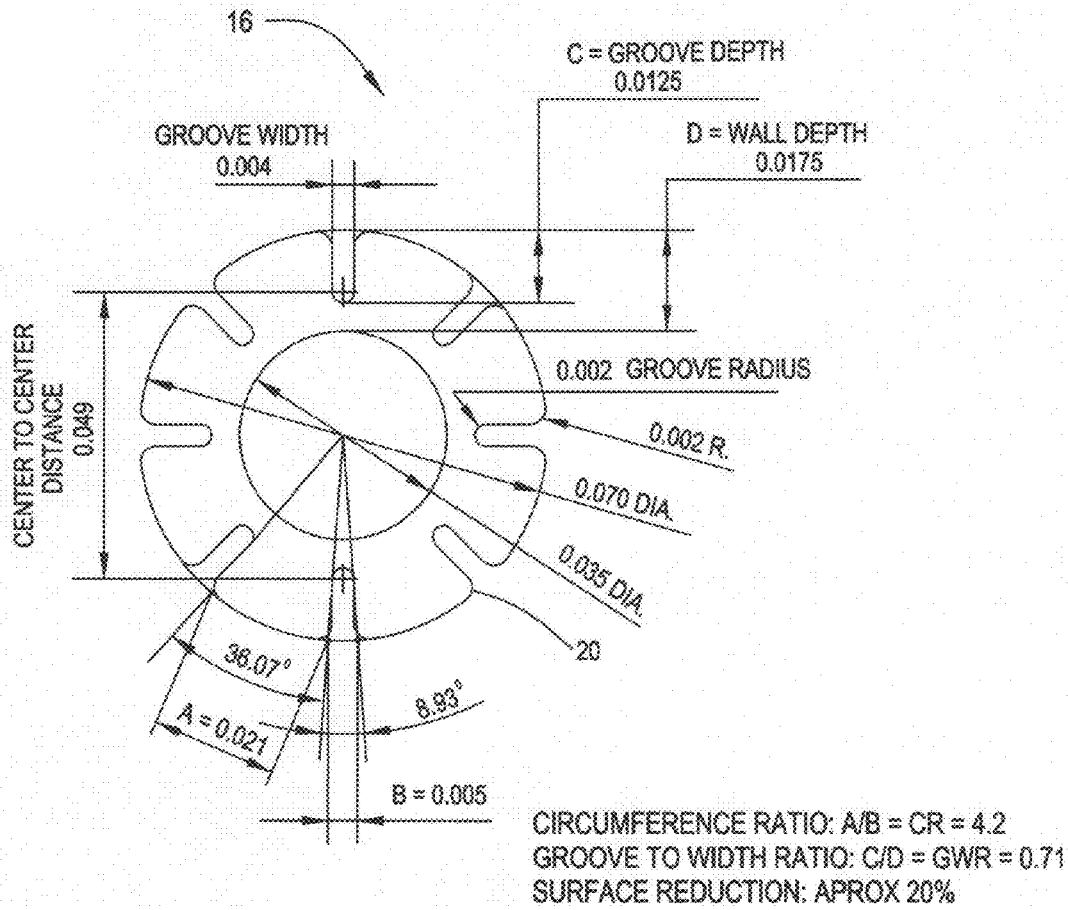
FIG. 4A shows a profiled bumper for the communications cable according to one embodiment.
Figure 4B:
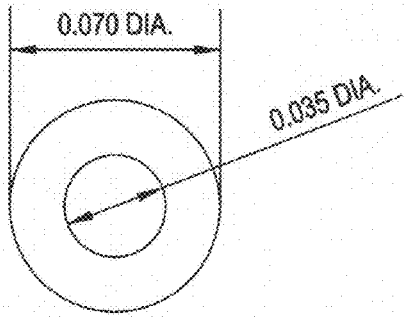
FIG. 4B (PRIOR ART)
FIG. 4B shows a profiled bumper for the communications cable according to the prior art.

Turning to details of the present invention, replacing the prior art bumpers shown in FIG. 3, a profiled shape for bumper 16 is shown in FIG. 4A, where a profiled bumper 16 is provided, with a comparison to prior art bumpers such as that shown in FIG. 4B. As shown in FIG. 4B, the normal bumper of prior art (4 pair LAN cable such as that in FIG. 2) may have an ID (Inner Diameter) of 0.035" and an OD (Outer Diameter of 0.070"). FIG. 4A shows the present bumper 16 with eight (8) grooves 20, but otherwise having the same ID and OD.

In FIG. 4A, the exemplary bumper 16 is formed as a hollow structure having eight (8) grooves 20 disposed substantially equally around the outer circumference, with FIG. 4A giving the dimensions of grooves 20.

As shown in FIG. 4A, the exemplary groove 20 width is 0.004", where the wall depth is 0.0175" and the groove 20 depth is 0.0125." The groove to wall ratio is 0.71 with a substantially 20% reduction in surface area.

Given the size and shapes of grooves 20 as disclosed in FIG. 4A, the following table expresses the weight reduction advantages of the arrangement in FIG. 4A relative to the prior art arrangement of FIG. 4B. Table 1 also shows the weight reduction that can be achieved with certain modifications to bumper 16 by adding 1-3 additional grooves 20 beyond the eight (8) grooves shown in FIG. 4A.

Weight Reduction Examples

TABLE 1

| | gms/1" | Reduction in weight |
|---|---|---|
| Round (standard - prior art) | 0.04502828 | |
| Profile Fillers | | |
| 8 Groove Outside | 0.03874255 | 13.96% |
| 9 Groove Outside | 0.03795683 | 15.70% |
| 10 Groove Outside | 0.03717112 | 17.45% |
| 11 Groove Outside | 0.0363854 | 19.19% |
| 8 Groove Inside and Outside | 0.03405532 | 24.37% |

Figure 5:
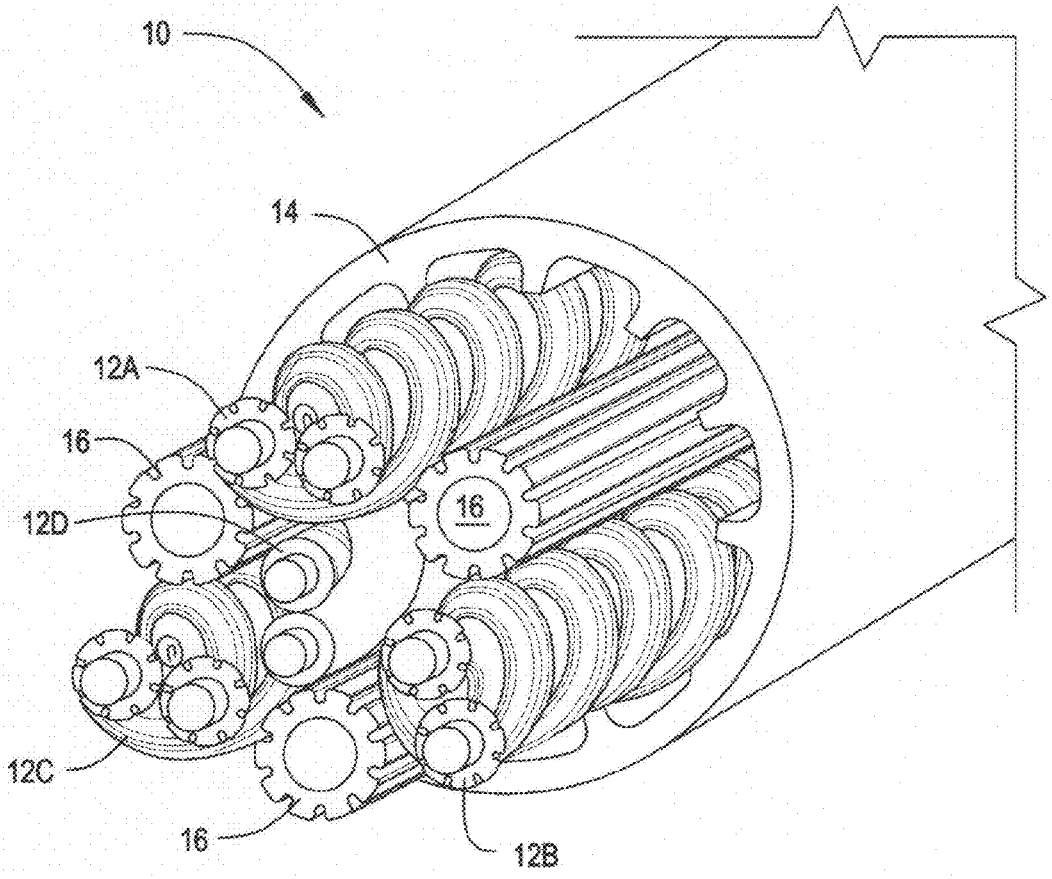
FIG. 5 shows the communications cable with the bumper of FIG. 4A according to one embodiment.

FIG. 5 shows cable 10 using three bumpers 16 as defined in FIG. 4A. As shown in FIG. 5, a helical twist may be applied to bumpers 16 which may have either a constant or varied lay length along the length of bumper 16 and may be either helical (left or right handed) or SZ (periodic reversals).

Figure 6A:
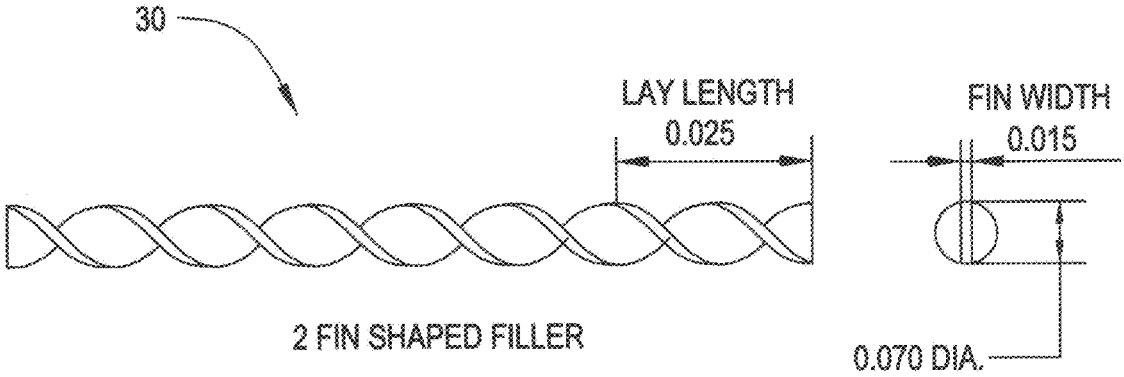
FIGS. 6A and 6B show a finned bumper for the communications cable according to one embodiment.
Figure 6B:
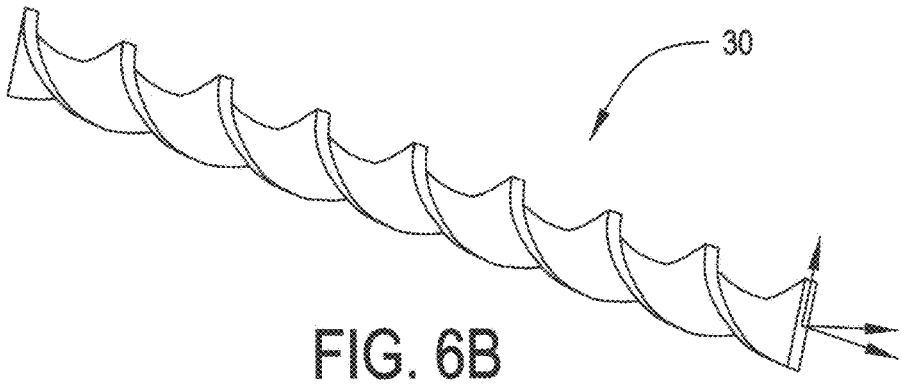

In another embodiment, as shown in FIGS. 6A and 63, instead of a round bumper 16 with profiles/grooves 20, a "fin" bumper 30 may be used in cable 10 to create a similar effect. FIGS. 6A and 6B illustrate one exemplary design having a two (2) fin shaped bumper 30. The two (2) fins are defined "two" splines extending from a center point (although such a bumper 30 appears to be a single helically would strip. However, for consistency, as outlined below, additional three (3) and four (4) spline designs for bumper 30 are within the contemplation of the present arrangement. The selection of one of such designs over the other may be based on, among other things, the desired material selection, required crush resistance, required electrical properties, etc. . . . and other such cable 10 construction requirements.

Returning to the two (2) fin design, in FIG. 6A, the exemplary bumper 30 is formed as a 0.015 polymer strip (with each end extending from the center being defined as one of the "fins") having a width of 0.070" as with the prior described bumper 16. In the example shown, the helical twist rate is 0.250" (per full rotation), but it is understood that other forms and rates of twisting may be used. FIG. 6B illustrates shows bumper 30 from FIG. 6A in profile.

Figure 7:
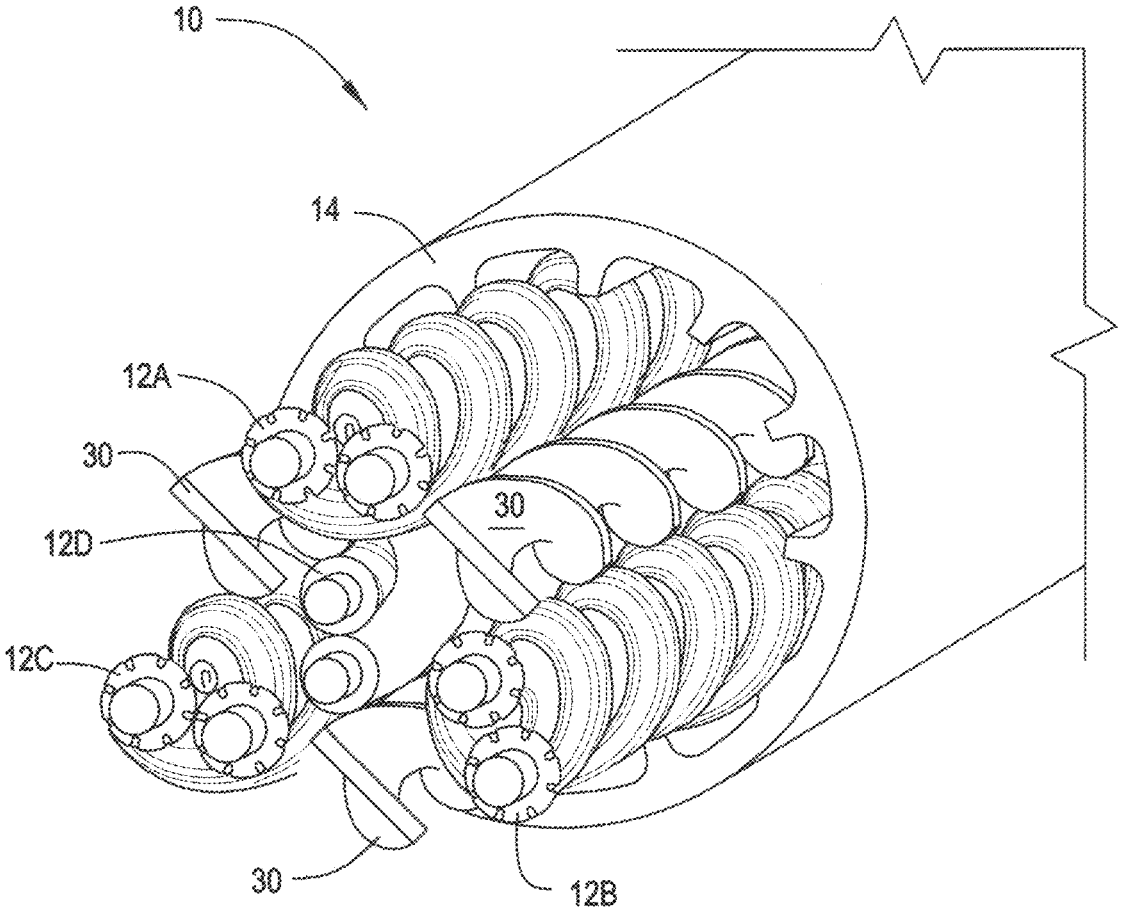
FIG. 7 shows the communications cable with the bumper of FIGS. 6A and 6B according to one embodiment.

FIG. 7 shows cable 10 using three bumpers 30 as defined in FIG. 6A.

Figure 8A:
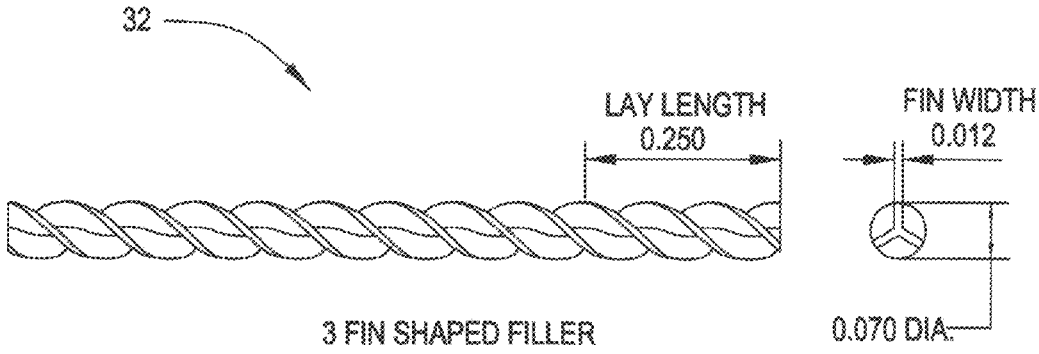
FIGS. 8A and 8B show a finned bumper for the communications cable according to one embodiment.
Figure 8B:
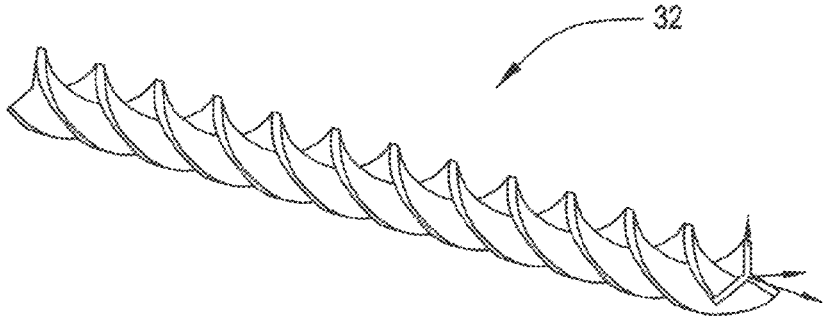

In another embodiment, as shown in FIGS. 8A and 8B, instead of a round bumper 16 with profiles/grooves 20, another fin bumper 32 may be used in cable 10 to create a similar effect. FIGS. 8A and 8B illustrate a three (3) fin shaped bumper 32. In FIG. 8A, the exemplary bumper 32 is formed as a 0.012" three finned polymer strip (with each of the three fins extending from the center) having an overall circumference of width of 0.070" as with the prior described bumper 16. In the example shown, the helical twist rate is 0.250" (per full rotation), but it is understood that other forms and rates of twisting may be used. FIG. 8B shows the exemplary three (3) fin bumper 32 from FIG. 8A in profile.

Figure 9:
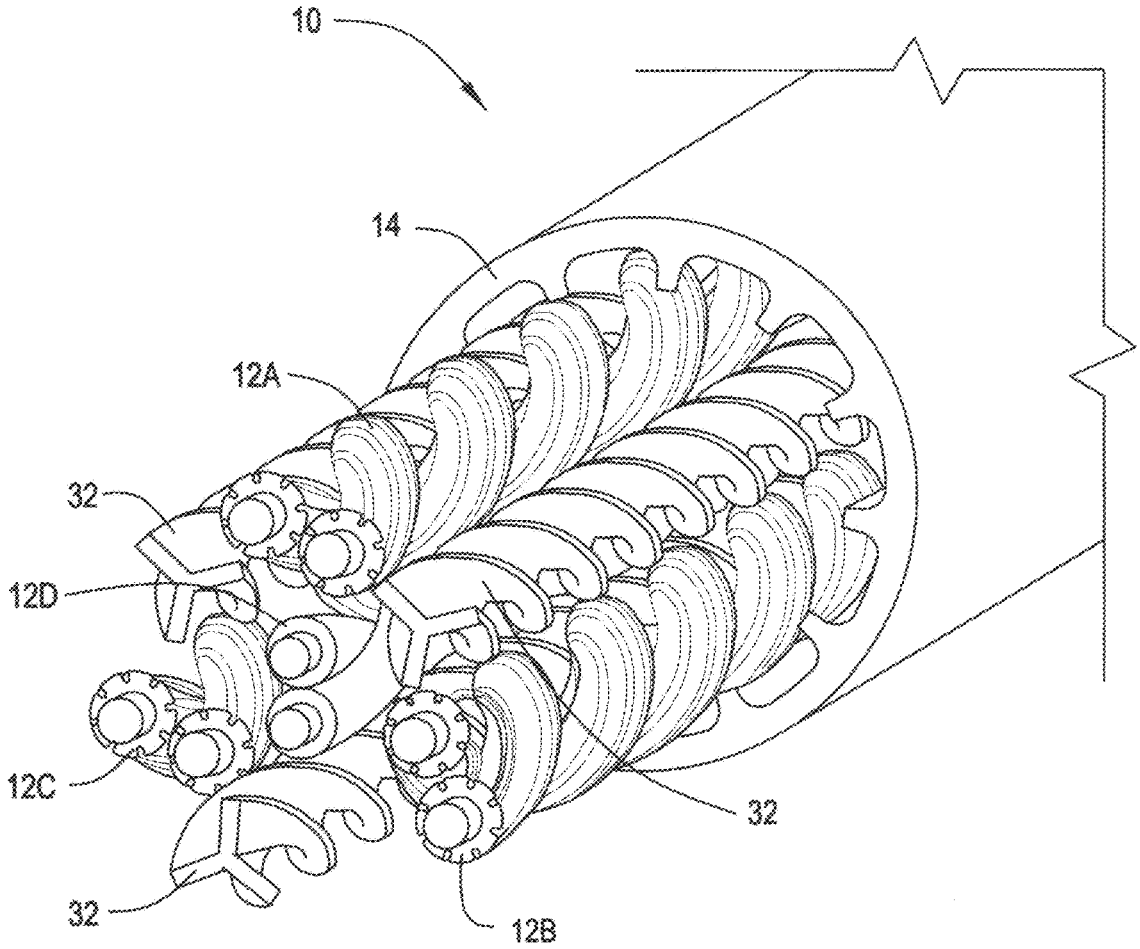
FIG. 9 shows the communications cable with the bumper of FIGS. 8A and 8B according to one embodiment.

FIG. 9 show cable 10 using three bumpers 32 as defined in FIG. 8A.

Figure 10A:
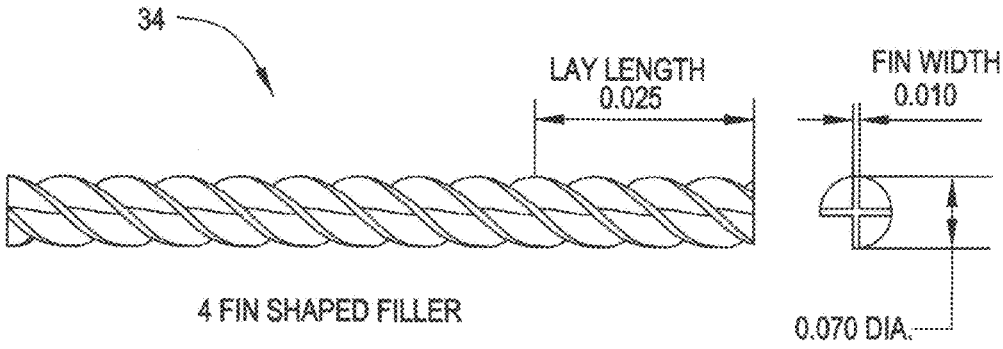
FIGS. 10A and 10B show a finned bumper for the communications cable according to one embodiment.
Figure 10B:
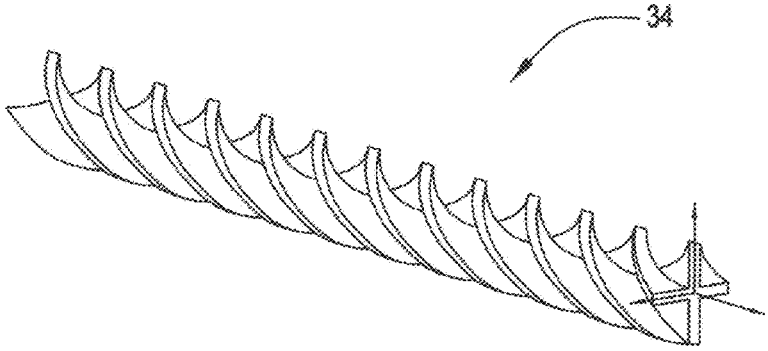

In another embodiment, as shown in FIGS. 10A and 10B, instead of a round bumper 16 with profiles/grooves 20, another fin bumper 34 may be used in cable 10 to similar effect. FIGS. 10A and 10B illustrate a four (4) fin shaped bumper 34. In FIG. 10A, the exemplary bumper 34 is formed as a 0.010" four finned polymer strip (with each of the four fins extending from the center) having an overall circumference of width of 0.070" as with the prior described bumper 16. In the example shown, the helical twist rate is 0.250" (per full rotation), but it is understood that other forms and rates of twisting may be used. FIG. 10B illustrates the exemplary four (4) fin bumper 34 from FIG. 10A in profile.

Figure 11:
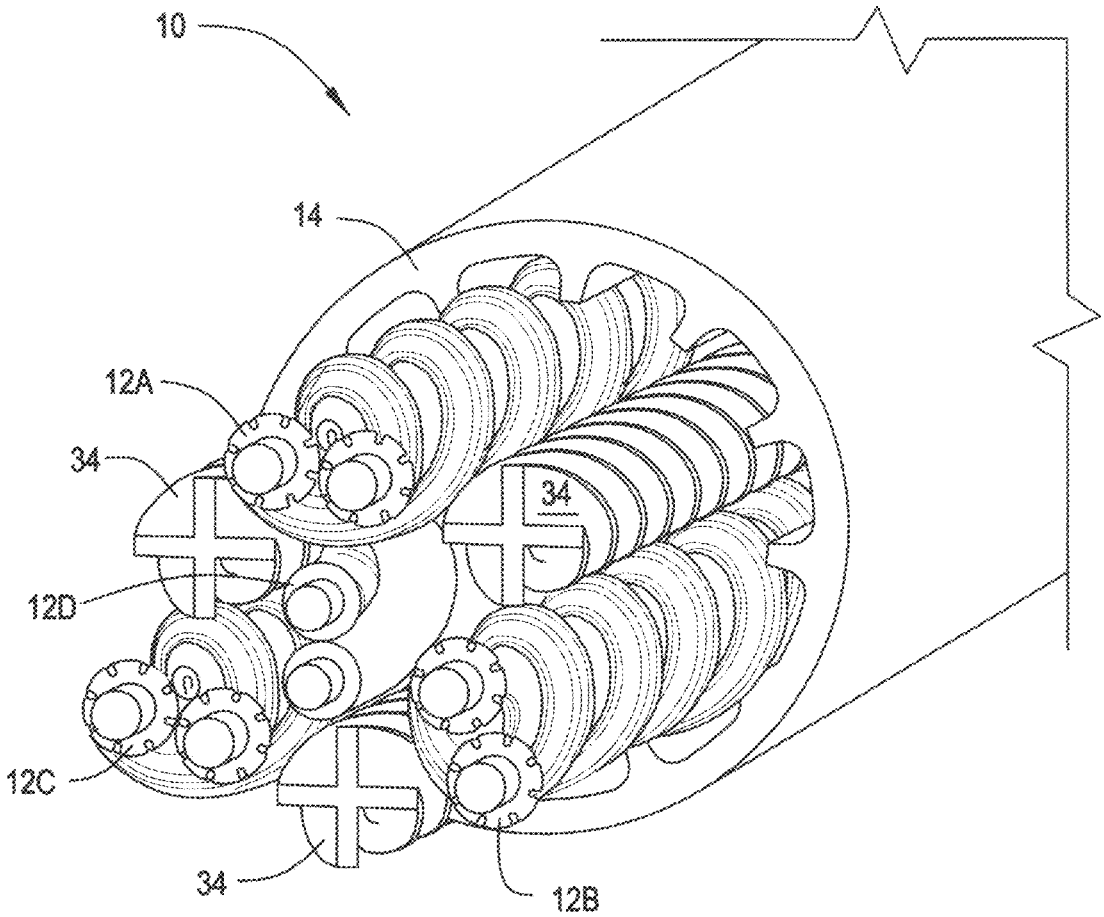
FIG. 11 shows the communications cable with the bumper of FIGS. 10A and 10B according to one embodiment.

FIG. 11 shows cable 10 using four bumpers 34 as defined in FIG. 10A.

Figure 12:
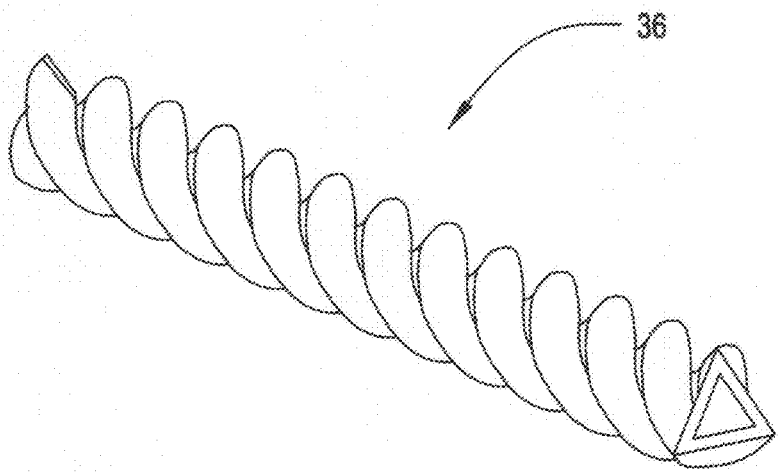
FIG. 12 shows a shaped bumper for the communications cable according to one embodiment.
Figure 13:
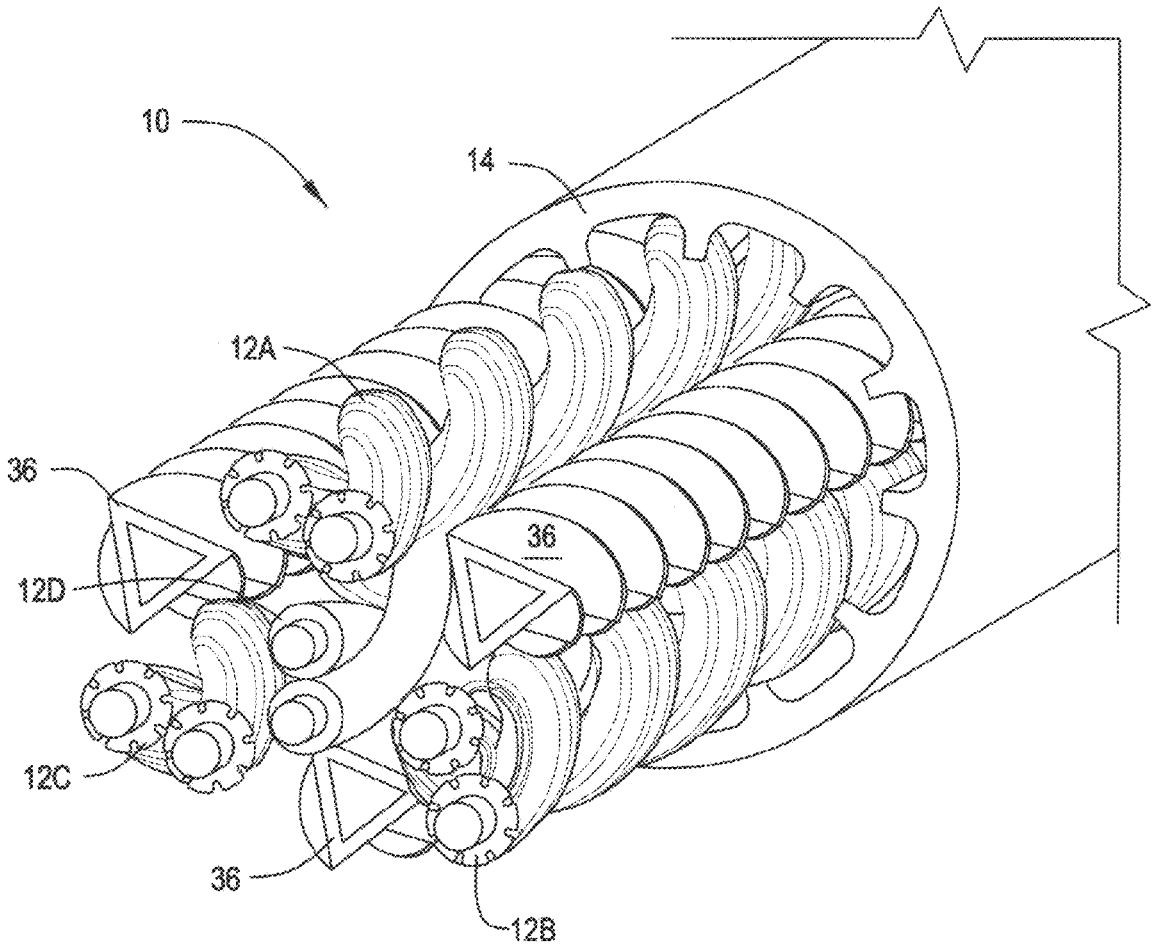
FIG. 13 shows the communications cable with the bumper of FIG. 12 according to one embodiment.

FIGS. 12 and 13 illustrate another embodiment which, instead of a round bumper 16 with profiles/grooves 20, a shaped triangle bumper 36 may be used in cable 10 to create a similar effect.

Figure 14:
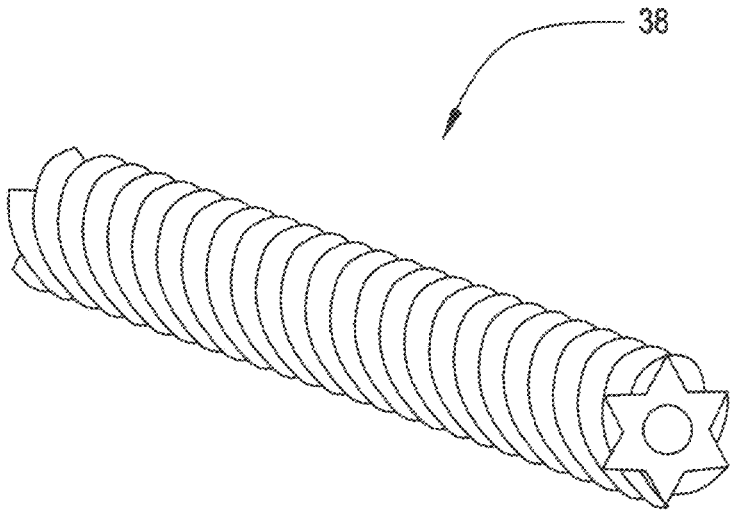
FIG. 14 shows a shaped bumper for the communications cable according to one embodiment.
Figure 15:
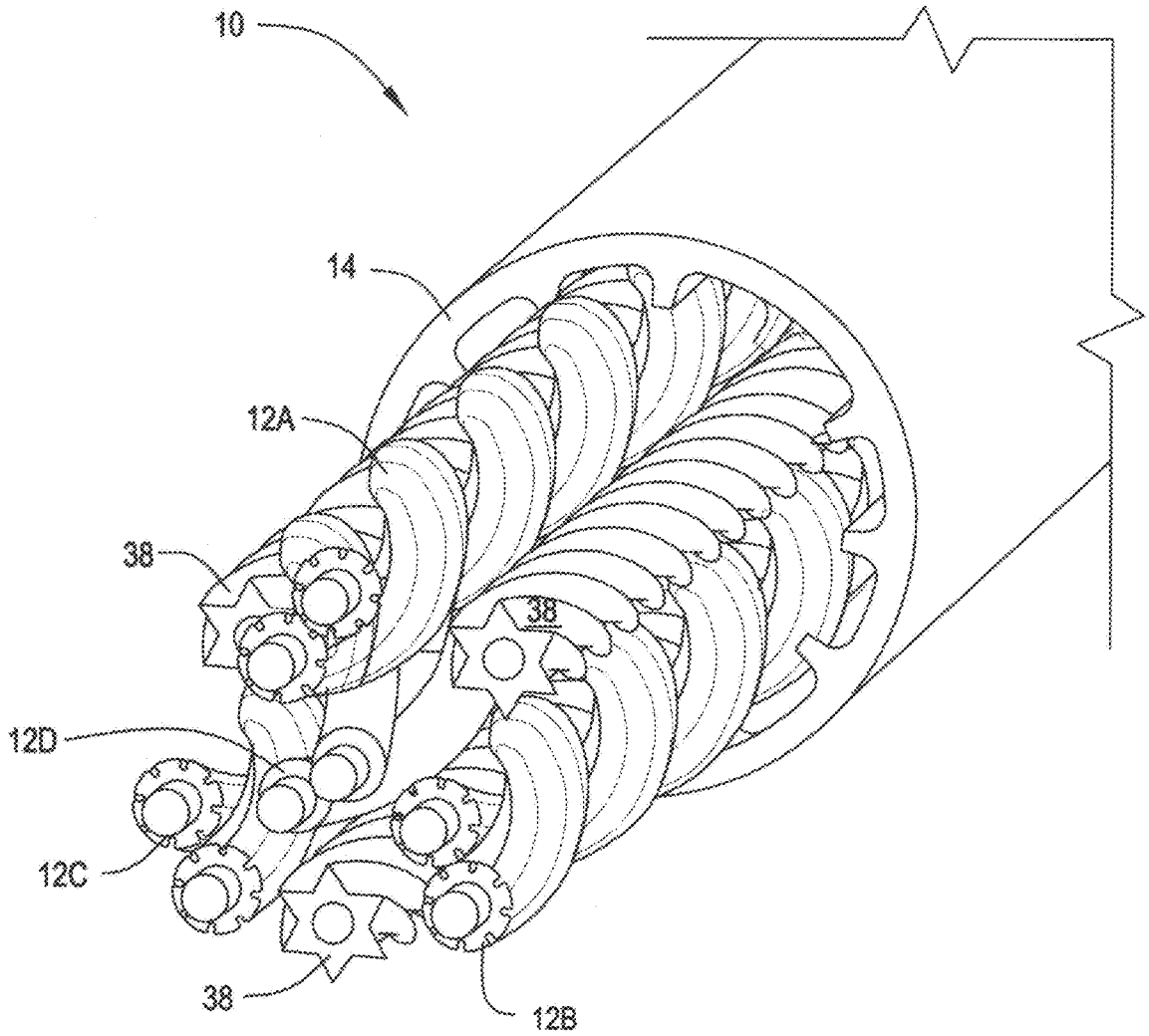
FIG. 15 shows the communications cable with the bumper of FIG. 14 according to one embodiment.

FIGS. 14 and 15 illustrate another embodiment which, instead of a round bumper 16 with profiles/grooves 20, a star shaped bumper 38 may be used in cable 10 to create a similar effect.

As with the profiled bumper 16 shown in FIGS. 4A, 43 and 5, each of the bumpers 30, 32, 34, 36 and 38 may employ a helical twist which may have either a constant or varied lay length along the length of the bumper(s) that can be either helical (left or right handed) or SZ (periodic reversals). The lay length of bumpers 30, 32, 34, 36 and 38 may employ a helical twist rate of substantially 1.00" but ranging from 0.010" to 10.00."

As with the weight reduction advantages discussed above in table 1, the finned and shaped bumpers 30, 32, 34, 36 and 38 (FIGS. 6, 8, 10, 12 and 14 respectively) also provide weight reduction advantages relative to the prior art arrangement of FIG. 4B as shown in the following Table 2.

Weight Reduction Examples

TABLE 2

| | gms/1" | Reduction in weight |
|---|---|---|
| Round (standard - prior art) | 0.04502828 | |
| Shaped Fillers | | |
| 2 fin 0.015" wall with .25" lay length | 0.01637222 | 63.64% |
| 3 fin 0.012" wall with .25" lay length | 0.01840088 | 59.13% |
| 4 fin 0.010" wall with .25" lay length | 0.01520377 | 66.24% |
| Triangle 0.010" wall with .25" lay length | 0.02026457 | 55.00% |
| Star .25" lay length | 0.02545299 | 43.47% |

Moreover, as shown in the following Table 3 the finned bumpers 30, 32 and 34 (FIGS. 6, 8 and 10) additionally provide surface area reduction relative to the prior art arrangement of FIG. 4B as shown in the following Table 3. These reductions in surface area relative to the prior art bumpers provide an added advantage in that they reduce the dielectric interference with the signals in the adjacent pairs 12.

Surface Area Reduction Examples

TABLE 3

| | 1" Long Surface Area (in ^2) | Reduction in Surface Area |
|---|---|---|
| Standard Round Filler 0.070" OD | 0.21991149 | |
| 2 Fin Sprial with 0.25" Lay Length | 0.03017138 | 86.28% |
| 3 Fin Sprial with 0.25" Lay Length | 0.03613513 | 83.57% |
| 4 Fin Sprial with 0.25" Lay Length | 0.03007738 | 86.32% |

It is noted that in the examples shown in FIGS. 4-15, each of cables 10 have the basic four (4) pairs 12 in typical LAN cables. However, as noted above, there is no restriction on using the bumpers 16 (or 30-38) in other twisted pair type LAN cables for similar geometric/shape retention.

Figure 16:
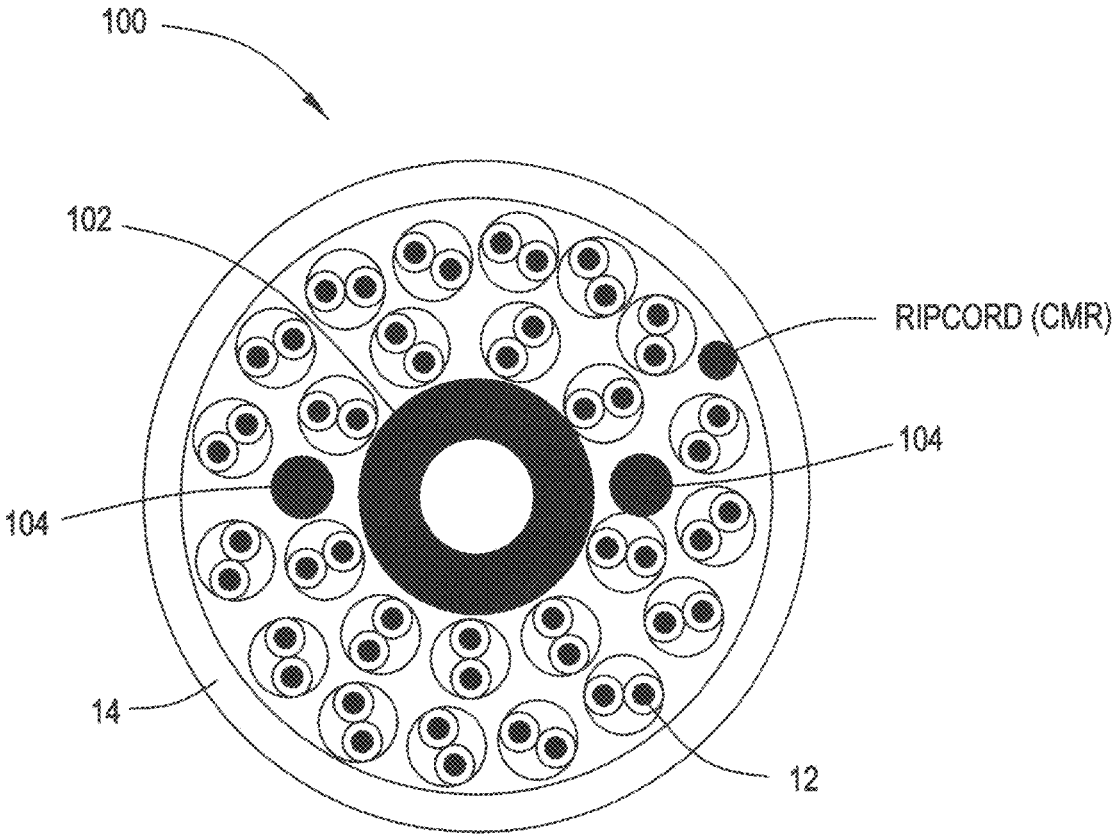
FIG. 16 (PRIOR ART)
FIG. 16 shows an exemplary prior art twenty five (25) pair cable.

For example, FIG. 16 shows an exemplary prior art twenty five (25) pair cable 100 which, among other components (pairs 12), includes a central spacing element 102 and peripheral spacers 104 that are used for maintaining the desired position of pairs 12 within the larger space enclosed by jacket 14 of cable 100.

Figure 17:
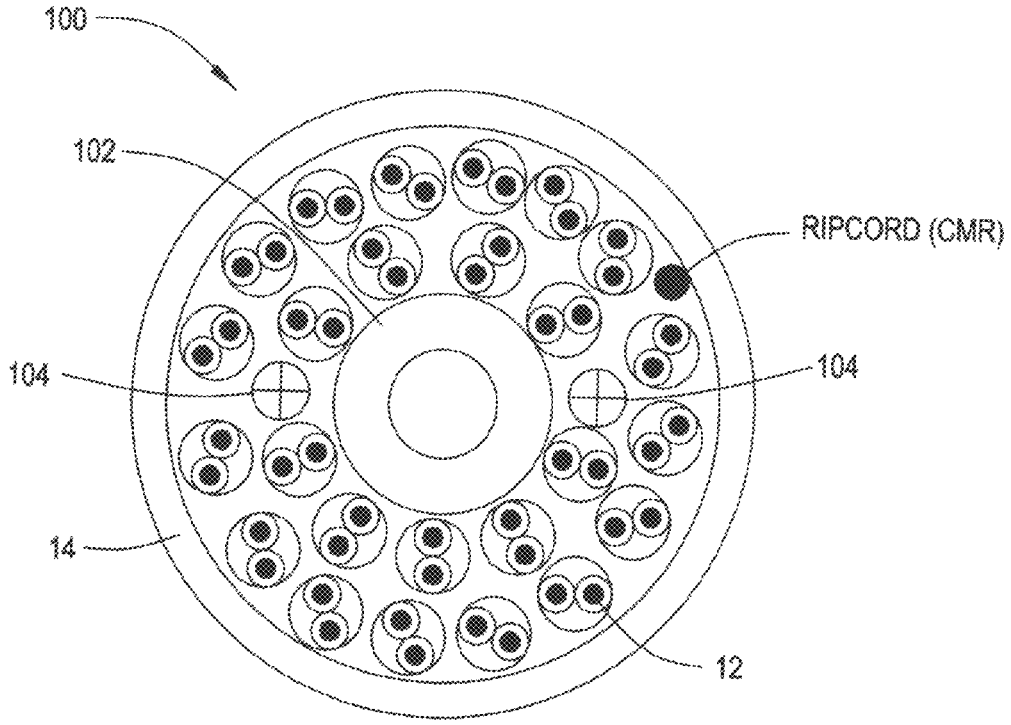
FIG. 17 shows a communications cable with a profiled bumper according to another embodiment.

In one embodiment shown in exemplary FIG. 17, the same cable 100 may utilizes the bumpers 16 (and/or 30-38) as described above. For example, in FIG. 17. For example, spacing element 102 and peripheral spacers 104, rather than being solid fillers, employ profiled bumpers 102, 104 (or shaped helical twisted fillers—not shown), conferring the same advantages outlined above, including reduction in weight material and dielectric interferences. It is understood that this larger twenty five (25) pair 12 LAN cable 100 is likewise a non-limiting example and that such profiled/shaped bumper elements 102 and 104 can equally be applied to small, mid-sized and even larger (25+) pair LAN cables as desired.

While only certain features of the invention have been illustrated and described herein, many modifications, substitutions, changes or equivalents now occur to those skilled in the art. It is therefore, to be understood that this application is intended to cover all such modifications and changes that fall within the true spirit of the invention.

What is claimed is:

1. A cable containing one or more polymeric elements for reduction of crosstalk, said cable comprising:

a plurality of unshielded twisted pairs, each of which is an insulated conductor pair twisted around one another, each having a different lay length;

a jacket enclosing said plurality of unshielded twisted pairs, wherein an unshielded twisted pair, having the longest lay length among said plurality of unshielded twisted pairs is positioned within the center of said jacket such that an axis of said twisted pair having the longest lay length substantially coincides with the central longitudinal axis of said cable and with said remaining unshielded twisted pairs positioned around said twisted pair with the longest lay length at the center; and a plurality of fin shaped bumper elements disposed within said jacket in the interstices between said plurality of unshielded twisted pairs, wherein said fin shaped bumper elements are polymer structures, having at least two fins radially extending from a center point, and having a diameter substantially the same size as a diameter of said unshielded twisted pairs, said fin shaped bumper elements having a helical twist of a lay length sufficient to prevent said remaining unshielded twisted pairs positioned around said twisted pair with the longest lay length at the center from contacting one another along the length of the cable.

2. The cable as claimed in claim 1, wherein said cable maintains four unshielded twisted pairs, each of different lay lengths.

3. The cable as claimed in claim 2, wherein the three non-longest lay length unshielded twisted pairs are located away from the center of said cable along an side diameter of said jacket, disposed substantially 120 degrees apart from one another.

4. The cable as claimed in claim 3, wherein said cable has three fin shaped bumper elements.

5. The cable as claimed in claim 4, wherein said three fin shaped bumpers are configured to hold said three non-longest lay length unshielded twisted pairs at said substantially 120 degrees apart from one another.

6. The cable as claimed in claim 1, wherein said fin shaped bumpers have any one of two, three and four fins per bumper.

7. The cable as claimed in claim 1, wherein said fin shaped bumpers provide substantially a 59%-66% reduction in weight relative to a round bumper having the same outside diameter.

8. The cable as claimed in claim 1, wherein said fin shaped bumpers are provided with a helical twist with a lay length of substantially 1.00" but ranging from 0.010" to 10.00."

9. The cable as claimed in claim 1, wherein said bumpers are finned bumpers that provide substantially a 83%-86% reduction in surface area relative to a round bumper with no profile having the same outside diameter.

10. The cable as claimed in claim 1 wherein said fin shaped bumpers are made of foamed polymer.

11. A cable for reducing crosstalk, said cable comprising:

a plurality of unshielded twisted pairs, each of which is an insulated conductor pair twisted around one another, said plurality of unshielded twisted pairs having different lay lengths;

a central spacing element around which said unshielded twisted pairs are arranged;

one or more peripheral fin shaped spacing elements arranged among said unshielded twisted pairs having at least two fins radially extending from a center point, and having a diameter substantially the same size as a diameter of said unshielded twisted pairs, said fin shaped spacing elements having a helical twist of a lay length sufficient to prevent said unshielded twisted pairs positioned adjacent to said fin shaped spacing element from moving into said space occupied by said fin shaped spacing element so as to maintain the spacing of said unshielded twisted pairs; and a jacket enclosing said plurality of unshielded twisted pairs and central and peripheral spacing elements.

* * * * *